US007757355B2

(12) United States Patent
Schmitz

(10) Patent No.: US 7,757,355 B2
(45) Date of Patent: Jul. 20, 2010

(54) APPARATUS ON A SPINNING PREPARATION MACHINE, ESPECIALLY A FLAT CARD, ROLLER CARD, OR THE LIKE, FOR ADJUSTING THE CARDING CLEARANCE

(75) Inventor: Thomas Schmitz, Mönchengladbach (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 781 days.

(21) Appl. No.: 11/723,480

(22) Filed: Mar. 20, 2007

(65) Prior Publication Data

US 2007/0220711 A1 Sep. 27, 2007

(30) Foreign Application Priority Data

Mar. 27, 2006 (DE) ..... 10 2006 014 419

(51) Int. Cl.
*D01G 15/12* (2006.01)

(52) U.S. Cl. ..... 19/98

(58) Field of Classification Search ..... 19/98–114
See application file for complete search history.

(56) References Cited

U.S. PATENT DOCUMENTS

| | | | | |
|---|---|---|---|---|
| 4,499,632 | A * | 2/1985 | Varga | 19/98 |
| 5,040,272 | A | 8/1991 | Fritzsche | |
| 5,127,134 | A * | 7/1992 | Demuth et al. | 19/102 |
| 2002/0069486 | A1 | 6/2002 | Wust et al. | |
| 2002/0088093 | A1 | 7/2002 | Wust et al. | |
| 2004/0099581 | A1* | 5/2004 | Schmitz | 209/615 |
| 2004/0154135 | A1* | 8/2004 | Leder | 19/98 |
| 2006/0016049 | A1 | 1/2006 | Schlichter et al. | |
| 2007/0119029 | A1* | 5/2007 | Schmitz et al. | 19/98 |

FOREIGN PATENT DOCUMENTS

| | | | |
|---|---|---|---|
| DE | 101 06 315 | A1 | 8/2002 |
| DE | 103 05 048 | A1 | 8/2004 |
| EP | 0 431 485 | A1 | 6/1991 |
| EP | 1231303 | A1 | 8/2002 |
| GB | 2 350 622 | A | 12/2000 |
| WO | WO 2004 106602 | A1 | 12/2004 |

OTHER PUBLICATIONS

German Search Report dated Sep. 28, 2006 issued in 10 2006 014 419.8.
United Kingdom Search Report dated Jun. 19, 2007 issued in GB0705678.1.

* cited by examiner

*Primary Examiner*—Shaun R Hurley
(74) *Attorney, Agent, or Firm*—Venable LLP; Robert Kinberg; Leigh D. Thelen

(57) ABSTRACT

An apparatus is provided on a spinning preparation machine for adjusting the carding clearance. A clothed roller has a cylindrical peripheral surface and a cladding facing and spaced therefrom, wherein between the peripheral surface of the roller and a part of the cladding there is a carding region with a carding clearance where carding work is performed and carding heat is generated, heat leading to an alteration across the width of the machine in the contour of at least one of the components lying opposite each other. In order in simple manner to allow a uniform carding clearance under different production and processing conditions, the carding clearance can be made smaller by external energy input to at least one of the components facing each other and/or can be enlarged by throttling the energy input and the energy input.

19 Claims, 5 Drawing Sheets

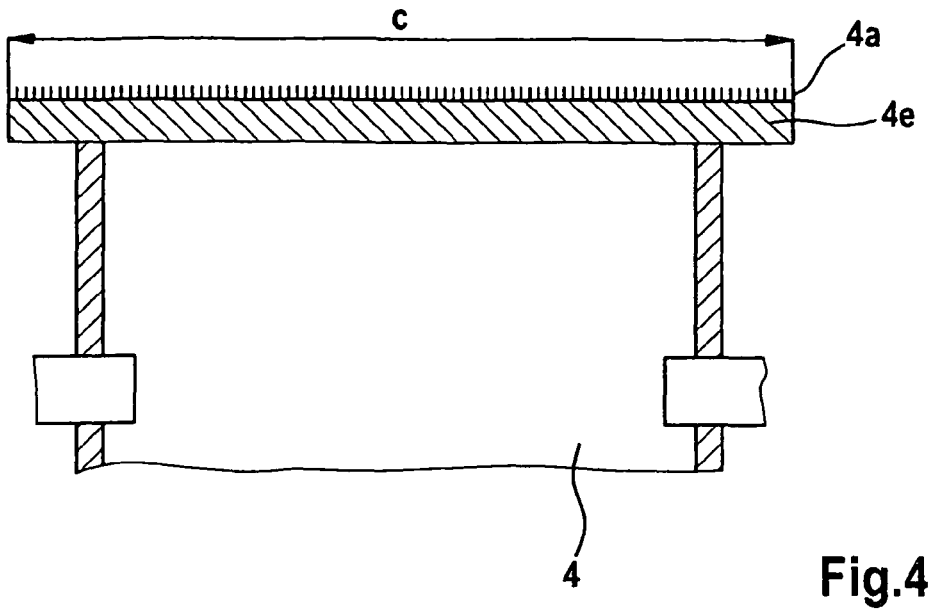
Fig.4b
Fig.5
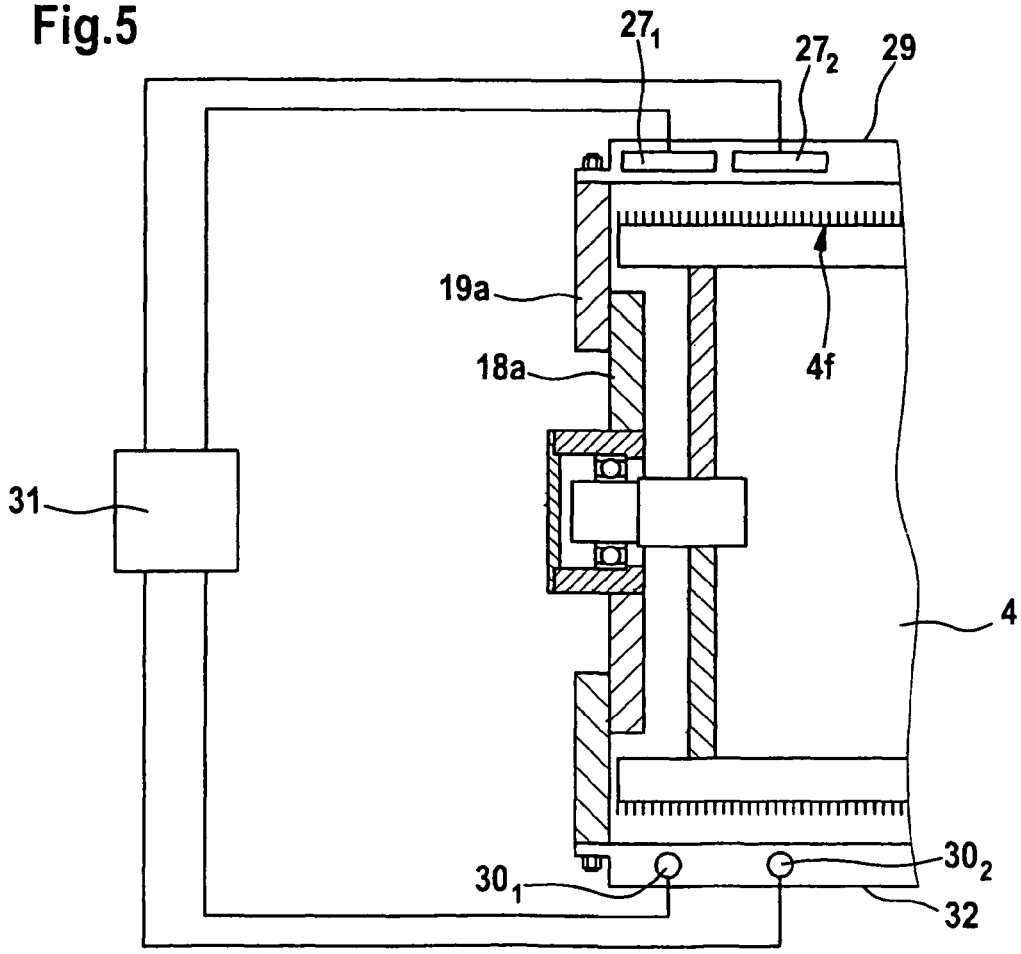

APPARATUS ON A SPINNING PREPARATION MACHINE, ESPECIALLY A FLAT CARD, ROLLER CARD, OR THE LIKE, FOR ADJUSTING THE CARDING CLEARANCE

CROSS REFERENCE TO RELATED APPLICATION

This application claims priority from German Patent Application No. 10 2006 014 419.8 dated Mar. 27, 2006, the entire disclosure of which is incorporated herein by reference.

BACKGROUND OF THE INVENTION

The invention relates to an apparatus on a spinning preparation machine, especially a flat card, roller card or the like, for adjusting the carding clearance.

It is known for a clothed roller, for example a cylinder, to have a cylindrical peripheral surface facing and spaced radially from a cladding, wherein between the peripheral surface of the roller and a part of the cladding there is a carding region with a carding clearance between clothings facing each other where carding work is performed and carding heat is generated, and in which heat leads to an alteration across the width of the machine in the contour of at least one of the components facing each other.

The distances between the cylinder clothing and surfaces (countersurfaces) facing them are of considerable importance in respect of engineering and fibre technology. The carding result, namely, degree of cleaning, nep formation and fibre shortening, is substantially dependent on the carding gap, that is, the clearance between the cylinder clothing and the clothings of the revolving and stationary flats. The air flow around the cylinder and the dissipation of heat are likewise dependent on the clearance between the cylinder clothing and facing clothed or also unclothed surfaces, for example, separation blades or cover elements. The clearances are subject to different, in some cases counteracting, influences. The wearing down of clothings facing each other results in an enlargement of the carding gap, which is associated with an increase in the number of neps and a reduction in fibre shortening. An increase in the speed of revolution of the cylinder, e.g. to enhance the cleaning action, results in an expansion of the cylinder inclusive of the clothing owing to the centrifugal force, and hence in a reduction in the carding gap. The cylinder expands also when processing large quantities of fibre and certain types of fibres, e.g. synthetic fibres, owing to a temperature increase that is greater than in the remainder of the machine surrounding the cylinder, so that the clearances also decrease for that reason. The machine elements lying radially opposite the cylinder, for example, stationary carding segments and/or separation blades, also expand.

The carding gap is influenced particularly by the machine settings on the one hand and the condition of the clothing on the other hand. The most important carding gap of a revolving flat card is located in the main carding zone, i.e. between the cylinder and the revolving flat assembly. At least one clothing, which delimits the operating clearance of the carding zone generally, is in motion. In order to increase the output of the card, efforts are made to select the operating speed of rotation and the operating speed of the moving elements as high as the technology of fibre processing will allow. The operating clearance is located in the radial direction (starting from the axis of rotation) of the cylinder.

In carding, ever larger amounts of fibre material are being processed per unit of time, which involves higher speeds of the work elements and higher installed capacities. With the work surface remaining constant, increasing throughput of fibre material (output) leads to greater generation of heat owing to the mechanical work. At the same time, however, the technological carding result (sliver uniformity, degree of cleaning, reduction of neps etc.) is continually being improved, which requires more active surfaces engaged in carding, and settings of these active surfaces closer to the cylinder (drum). The proportion of synthetic fibres to be processed is continually increasing, with more heat, compared with cotton, being produced as a result of friction from contact with the active surfaces of the machine. The work elements of high-performance cards are today fully enclosed all round in order to comply with the high safety standards, prevent particle emission into the spinning works environment and minimise the need for maintenance of the machines. Gratings or even open, material-guiding surfaces that allow exchange of air belong to the past. The circumstances described appreciably increase the input of heat into the machine, whereas there is a marked decrease in the discharge of heat by means of convection. The resulting increased heating of high-performance cards leads to greater thermoelastic deformations, which have an influence on the set spacings of the active surfaces owing to the uneven distribution of the temperature field: the distances between cylinder and card top, doffer, fixed card tops and separation points with blades decrease. In an extreme case, the gap set between the active surfaces can close up completely as a result of thermal expansion, so that components moving relative to one another collide. The high-performance card concerned then suffers considerable damage. Moreover, in particular the generation of heat in the working region of the card can lead to different thermal expansions when the temperature differences between components are too large.

To reduce or avoid the risk of collisions, in practical operation the carding gap between clothings facing each other is set to be relatively wide, i.e. a certain safety clearance exists. A large carding gap, however, leads to undesirable nep formation in the card sliver. In contrast, an optimum, especially narrow size is desirable, whereby the nep count in the card sliver is substantially reduced. Displacement relative to one another of the elements facing each other leads to a change in the clearance (carding gap) across the overall width of the machine.

The carding gap has a significant influence on the carding result. That is to say, a carding gap that is as uniformly narrow as possible across the working width produces optimum results. For the cylinder, it follows from this that the integrity of its cylindrical shape is of crucial importance. With reference to the cylinder, there is a further problem in that it is unevenly heated across the working width as a result of varying material coverage and fluctuations in the gap as a consequence of manufacturing tolerances. In addition, heat is dissipated more at the edge regions than in the middle, so that heat accumulates in the middle. This leads to a temperature gradient from the middle of the working width to the edges. The different thermal expansion brought about by this causes a convexly shaped bulging (camber) of the cylinder and thus impairs the carding gap. The carding result is consequently adversely affected. Since the cylinder is a counterpart for all carding and separation points, this loss of quality occurs at all points. In the case of the elements facing each other, e.g. the cylinder and carding elements, generation of heat during operation causes a marked expansion in the middle that reduces towards the edge regions. The disadvantage is that the carding gap is thus uneven across the width of the card and in the middle region there is a risk of collision between the components.

In a known apparatus (WO 2004/106602 A), in the case of a roller and a work element that face each other at least one contour is made concave (hollow) in the course of manufacture. The extent of the hollow machining corresponds to the expected thermal expansion during an intended output. The correction is designed for an ideal output amount. In particular, allowances are made for the expected expansions such that no re-adjustment of the spacing of the individual components with respect to one another is needed. One disadvantage is that presetting of a specific concave contour allows only a single alteration in the curved shape of the elements during operation. Adaptation to changed processing conditions, especially a change in the fibre material volume and quality, is therefore not possible. In addition, it is inconvenient that the inherent heat of the elements in operation, which causes the expansions, is constant, so that the curved form is correspondingly constant and cannot be adapted to changed production conditions.

SUMMARY OF THE INVENTION

It is an aim of the invention to produce an apparatus of the kind mentioned at the beginning, which avoids or mitigates the said disadvantages, and which in particular in a simple manner allows a uniform carding gap (carding clearance), preferably under different production and processing conditions.

The invention provides an apparatus on a spinning preparation machine for adjusting a carding clearance, in which a clothed roller is opposed to one or more machine elements, defining between the clothing of the clothed roller and said one or more machine elements an adjustable carding clearance where, in operation, carding is effected and carding heat is generated, and the contour of at least one of the clothed roller and at least one said opposed element is alterable in response to heat, wherein the apparatus comprises a device for input of energy to at least one of said roller and at least one said opposed element, in which the carding clearance can be made smaller by the input of energy to said at least one of said roller and at least one said opposed element and/or can be enlarged by throttling of said input of energy.

Because the energy, preferably heat, is generated by an external device, that is, a device that is present expressly for the purpose of inputting energy to one of the components defining the carding gap, preferably a heater apparatus, this enables an influence independent of the constant carding heat to be exerted on the contour of at least one of the components facing each other. In this simple manner the contour can be specifically altered and adjusted during operation so that the carding gap is constant across the width. A particular advantage is that even in the case of different production and processing conditions, the carding clearance is correspondingly adjustable to accommodate them. The temperature gradient is neatly minimised across the working width and the thermal expansion is thereby rendered uniform.

The roller may, for example, be the cylinder of a flat card or roller card. The opposed element may be a carding element, for example a stationary carding element, or may be a separating blade, a guide element, or a further clothed roller. There may be one or more further opposed elements, which may comprise one or more of a carding element, a separating blade, a guide element and a clothed roller, for example, a doffer or a licker-in.

If desired, the contour of just one component may be alterable. In other embodiments, the contour of both the roller and an opposed component or opposed components may be alterable. Advantageously, there is supplied, as said energy, heat.

At least one component may be heated by energy input. Advantageously, at least one component is heated by induction heat in the component. Advantageously, at least one contour is alterable in operation, and preferably the at least one contour is adjustable in operation. In preferred arrangements, in which the carding clearance alters in operation, the carding clearance is adjustable in operation.

In certain embodiments, no energy or heat input is effected in the middle region of the at least one component. Advantageously, at least one component is heatable in zones. Preferably, the surface of the cylinder is heatable in zones. Advantageously, a heating device is associated with the at least one component. The heating device may be associated with the surface (peripheral surface) of the roller, e.g. cylinder. In certain embodiments, the heating device is externally associated with the surface (peripheral surface) of the roller. In further embodiments, the heating device is associated with the roller in the inner space of the surface (inner peripheral surface), for example, ribs or the like for increasing the heat absorption may be present on the inner peripheral surface.

Where a heating device is present the heat output of the heating device is adjustable across the working width. The heating device may be divided into several zones across the working width. The heating device may be so arranged that different quantities of heat are introducible into the roller surface. There may be used, for example, an electrical heating device or an inductive heating device. Where present, the heating device may be arranged in a carrier arrangement. The carrier arrangement may be a profiled element. The heating device may be integrated in an aluminium profiled member. Advantageously, the heating device is capable of heating the edge regions of the at least one component, e.g. the roller, in zones. In some embodiments, the heating device is connected to an electrical open loop and closed loop control device.

The roller is advantageously a carding cylinder consisting of a ferromagnetic material, e.g. steel.

If desired, the energy input can be effected across the entire width of the at least one component. In certain preferred embodiments comprising an inductive heating device, the apparatus preferably comprises a controllable electrical power circuit for changing the heat generated by inductive energy input.

In many embodiments, an external device is usable for generation or input of energy.

The carrier arrangement for the heating device or other external energy-input device may be mounted, for example, on the extension bends of a flat card or roller card, or on the side panels of a flat card.

The apparatus is, in certain advantageous embodiments, constructed to be interchangeable in modular manner with one or more other components of the machine. For example, a plurality of covering or work elements (modules) of the same dimension are present at the roller, the dimensions of the carrier arrangement over the length and width being arranged to be the same or substantially the same as those of a covering element or work element (module).

In certain embodiments, a control means is provided, in order to control the energy input after the warm-up phase to adjust a narrow carding gap across the width. Where provided the control means may, if desired, be arranged, after the machine reaches a stable operating state, to control the energy input for renewed correction of the carding clearance, for example, in order to make allowances for wear and/or grinding processes.

The invention also provides an apparatus on a spinning preparation machine, especially a flat card, roller card or the like, for adjusting the carding clearance, in which a clothed roller, for example a cylinder, has a cylindrical peripheral surface facing and spaced radially from a cladding, wherein between the peripheral surface of the roller and a part of the cladding there is a carding region with a carding clearance between clothings facing each other where carding work is performed and carding heat is generated, and in which heat leads to an alteration across the width of the machine in the contour of at least one of the components facing each other, wherein the carding clearance is capable of being made smaller by external energy input to at least one of the components facing each other and/or is capable of being enlarged by throttling the energy input and the energy input and/or throttling of the energy input increases towards the edge regions of the components.

Furthermore, the invention provides an apparatus on a spinning preparation machine, especially a flat card, roller card or the like, for adjusting the carding clearance, in which a clothed roller, for example a cylinder, has a cylindrical peripheral surface and a cladding facing and spaced therefrom, wherein between the peripheral surface of the roller and a part of the cladding there is a carding region with a carding clearance between clothings facing each other where carding work is performed and carding heat is generated, and in which heat results in an expansion across the width of the machine of at least one of the components facing each other, wherein the carding clearance can be made smaller by external energy input to at least one of the components facing each other and/or is can be enlarged by throttling the energy input and the energy input and/or throttling of the energy input is effected uniformly across the width.

BRIEF DESCRIPTION OF THE DRAWINGS

FIG. 4*b* shows the flat (straight) casing of the cylinder of FIG. 4*a* with a flat (straight) contour after external energy input;

FIG. 5 shows schematically a block circuit diagram with an open loop and closed loop control device to which four controllable heating devices and four temperature sensors of a device according to the invention are connected.

DETAILED DESCRIPTION OF PREFERRED EMBODIMENTS

Figure 1:
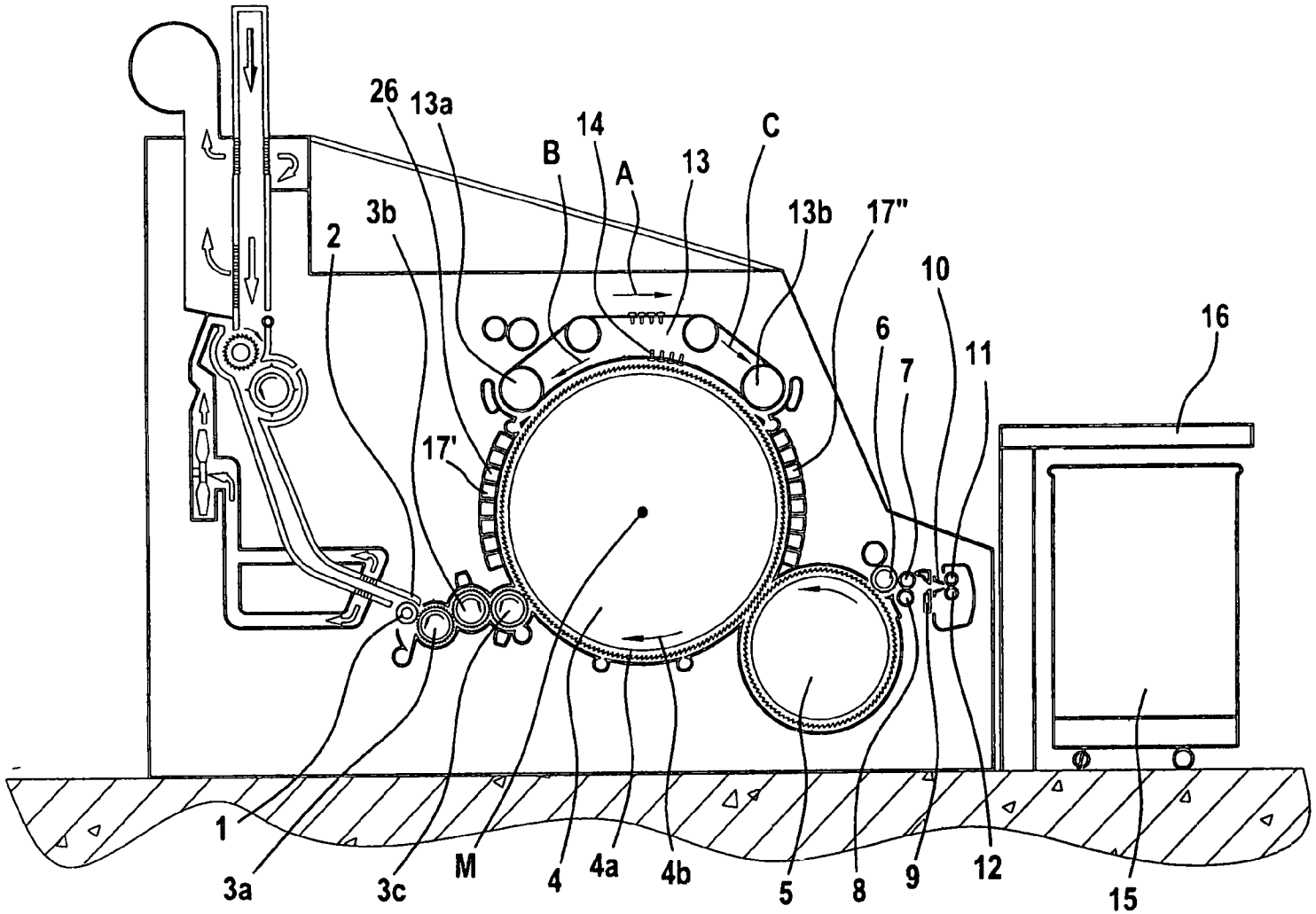
FIG. 1 is a schematic side view of a flat card with a heating device according to the invention.

With reference to FIG. 1 a card, for example, the card TC 03 made by Trützschler GmbH & Co. KG of Monchengladbach, Germany, has a feed roller 1, feed table 2, licker-ins 3*a*, 3*b*, 3*c*, cylinder 4, doffer 5, stripping roller 6, squeezing rollers 7, 8, web-guide element 9, web funnel 10, take-off rollers 11, 12, revolving flat 13 with flat guide rollers 13*a*, 13*b* and flat bars 14, can 15 and can coiler 16. The directions of rotation of the rollers are shown by respective curved arrows. The letter M denotes the midpoint (axis) of the cylinder 4. The reference numeral 4*a* denotes the clothing and reference numeral 4*b* denotes the direction of rotation of the cylinder 4. The letter B denotes the direction of rotation of the revolving flat 13 in the carding position and the letter C denotes the reverse transport direction of the flat bars 14. Stationary cover and work elements, e.g. stationary carding elements $\mathbf{17}^{I}$, are arranged between the licker-in 3*c* and the rear flat guide roller 13*a* and stationary cover and work elements, e.g. stationary carding elements $\mathbf{17}^{II}$, are arranged between the front licker-in 3*a* and the doffer 5. The letter A denotes the work direction. The curved arrows drawn in the rollers denote the direction of rotation of the rollers. The numeral 2 denotes a heating device according to the invention.

Figure 2:
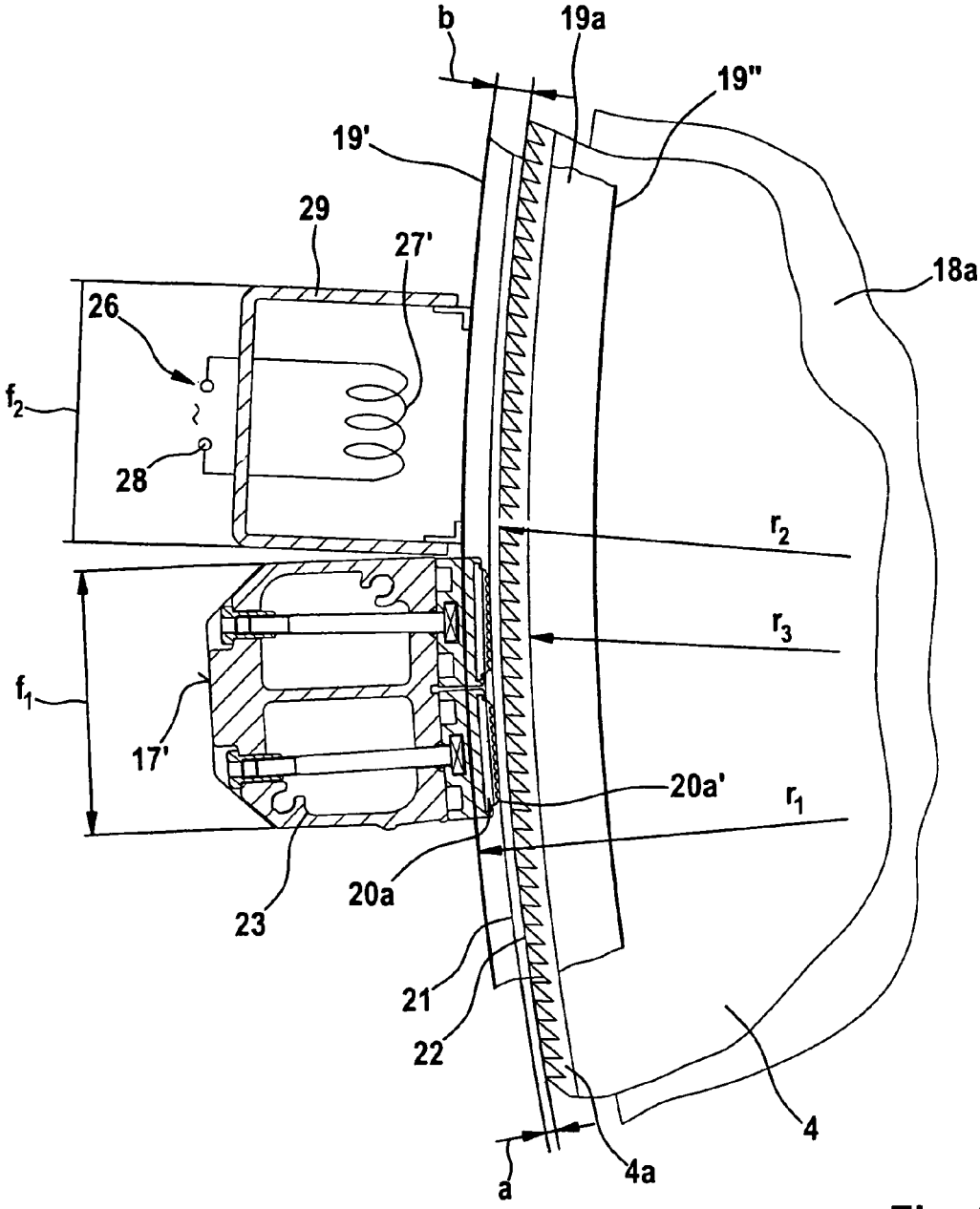
FIG. 2 shows a cutout from a side panel with an extension bend section, on which a heating device according to the invention and a stationary carding element are mounted.
Figure 3:
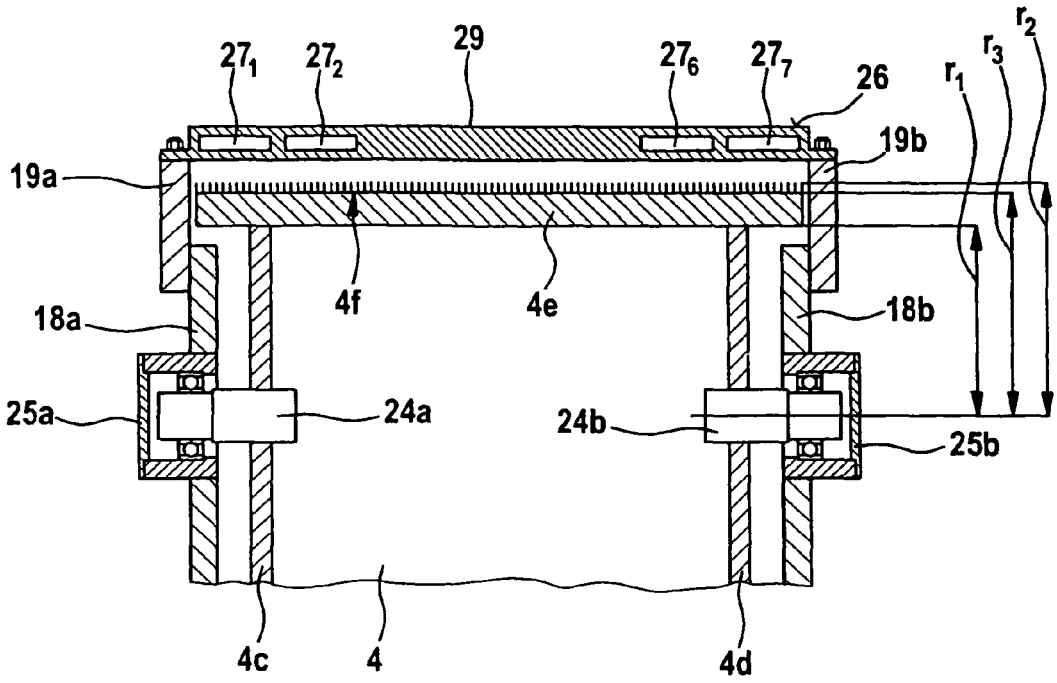
FIG. 3 is a plan view of a partial section through the cylinder of the flat card of FIG. 1 and of the supporting profile arranged across the working width with heating units in the edge regions of the cylinder.

In the illustrative embodiment shown in FIG. 2, on each side of the card an approximately semi-circular, rigid side panel 18*a*, 18*b* (see FIG. 3) is secured laterally to the machine frame (not shown); mounted, e.g. by screws, on the outside of the side panel, concentrically in the region of the periphery thereof, there is a curved bearing element 19*a*, 19*b* (extension bend)—see FIG. 3—, which has a convex outer surface $\mathbf{19}^{I}$ as its bearing surface and an underside $\mathbf{19}^{II}$. At both ends the carding element $\mathbf{17}^{I}$ has bearing surfaces, which lie on the convex outer surface $\mathbf{19}^{I}$ of the bearing element 19. Mounted on the underside of the carding segment $\mathbf{17}^{I}$ are carding elements 20*a*, 20*b* with carding clothings $\mathbf{20}a^{I}$, $\mathbf{20}b^{I}$. The reference numeral 21 denotes the tip circle of the clothings. The cylinder 4 has on its periphery a cylinder clothing 4*a*, for example, a saw tooth clothing. The reference numeral 22 denotes the tip circle of the cylinder clothing 4*a*. The distance between the tip circle 21 and the tip circle 22 is denoted by the letter a, and is, for example, 0.20 mm. The distance between the convex outer surface $\mathbf{19}^{I}$ and the tip circle 22 is denoted by the letter b. The radius of the convex outer surface $\mathbf{19}^{I}$ is denoted by $r_1$ and the radius of the tip circle 22 is denoted by $r_2$. The radii $r_1$ and $r_2$ intersect at the mid-point M (see FIG. 1) of the cylinder 4. The carding segment $\mathbf{17}^{I}$ shown in FIG. 2 consists of a support 23 and two carding elements 20*a*, 20*b*, which are arranged in succession in the direction of rotation (arrow 4*b*) of the cylinder 4, the clothings $\mathbf{20}a^{I}$, $\mathbf{20}b^{I}$ of the carding elements 20*a*, 20*b* and the clothing 4*a* of the cylinder 4 lying facing each other.

The heating device 26, viewed in the direction of rotation 4*b* of the cylinder 4, is arranged next to the carding segment $\mathbf{17}^{I}$. The heating device 26 comprises, as housing 29, a hollow aluminium profiled member, in the inner space of which an inductive heating apparatus 27 is arranged. The heating apparatus 27 comprises an induction coil $\mathbf{27}^{I}$, which is connected to an alternating current supply 28. The widths of the elements carding segment $\mathbf{17}^{I}$ and heating device 26 mounted on the extension bends 19*a*, 19*b* is denoted by $f_1$ and $f_2$ respectively.

FIG. 3 shows a part of the cylinder 4 with a cylindrical surface 4*f* of the casing 4*e* and cylinder end discs 4*c*, 4*d* (radial supporting elements). The surface 4*f* is provided with a clothing 4*a*, which in this example is in the form of wire with saw-teeth. The saw-tooth wire is drawn onto the cylinder 4, i.e. is wound round in tightly adjacent turns between side flanges (not shown) in order to form a cylindrical work surface equipped with tips. Fibres are intended to be processed as evenly as possible on the work surface (clothing). The carding work is carried out between the clothings $\mathbf{20}a^{I}$, $\mathbf{20}b^{I}$ and 4*a* located facing each other. It is influenced substantially by the position of the one clothing with respect to the other and by the clothing spacing a between the tips of the teeth of the two clothings 20*a*, 20*b*, and 4*a*. The working width of the cylinder 4 is a determining factor for all other work elements of the card, especially for the revolving flats 14 or stationary flats $\mathbf{17}^{I}$, $\mathbf{17}^{II}$ (FIG. 1) which, together with the cylinder 4, card the fibres evenly across the entire working width. In order to be able to perform even carding work across the entire working width, the settings of the work elements (including those of additional elements) across this working width must be maintained. The cylinder 4 itself, however, can be deformed as a result of drawing-on the clothing wire, by centrifugal force or by the heat generated by the carding process. The shaft journals 24*a*, 24*b* of the cylinder 4 are mounted in bearings 25*a*, 25*b*, which are attached to the stationary machine frame, not shown. The diameter, for example 1250 mm, of the cylindrical top surface 4*f*, that is to say twice the radius $r_1$, is an important dimension of the machine. The side panels 18*a*, 18*b* are secured to the two machine frames (not shown). The extension bends 19*a*, 19*b* are secured to the side panels 18*a*, 18*b* respectively. The circumferential speed of the cylinder 4 is, for example, 35 m/sec. The two end regions of the housing 29 of the heating device 26, which extends across the width c of the cylinder 4, are fastened to the extension bends 19*a*, 19*b*. Inside the housing 29 there are four inductive heating devices 27, two heating devices $\mathbf{27}_1$, $\mathbf{27}_2$ lying opposite one edge region $\mathbf{4}e^{I}$ of the casing 4*e* of the cylinder 4 and two further heating devices $\mathbf{27}_6$, $\mathbf{27}_7$ lying opposite the other edge region 4*e*, of the casing 4*e* of the cylinder 4—in each case spaced therefrom. The heating devices $\mathbf{27}_1$, $\mathbf{27}_2$, $\mathbf{27}_6$, $\mathbf{27}_7$ are arranged side by side across the width c in the axial direction of the cylinder 4.

Figure 4A:
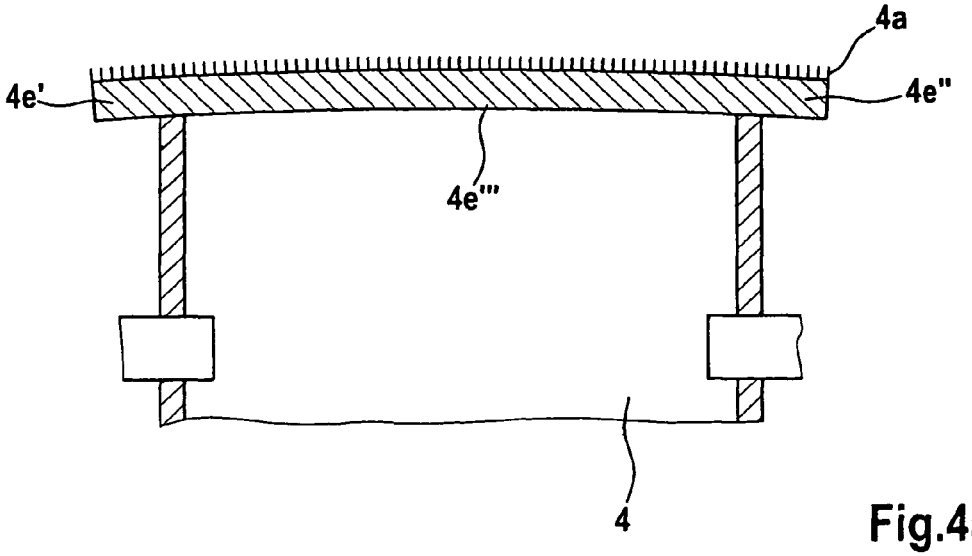
FIG. 4*a* shows the convexly curved casing of a carding cylinder across the working width with a convexly curved contour resulting from carding heat without external energy input.

FIG. 4*a* shows—drawn to an exaggerated extent—the convexly curved contour of the casing 4*e* that has bulged owing to thermal expansion during operation. In relation to the middle region $\mathbf{4}e^{III}$, in which the expansion is greatest, the two edge regions $\mathbf{4}e^{I}$ and $\mathbf{4}e^{II}$ drop away towards both sides, especially on account of the greater heat dissipation towards the sides. Because the heating devices $\mathbf{27}_1$, $\mathbf{27}_2$ and $\mathbf{27}_6$, $\mathbf{27}_7$ (see FIG. 3) heat up the edge regions $\mathbf{4}e^{I}$ and $\mathbf{4}e^{II}$, the edge regions $\mathbf{4}e^{I}$, $\mathbf{4}e^{II}$ expand, so that, as shown in FIG. 4*b*, the surface of the casing 4*e* is even and flat across the width c and the diameters $r_1$ and $r_3$ (see FIG. 3) of the casing 4*e* of the cylinder 4 are the same at all points across the width.

In a further embodiment shown in FIG. 5 (only one side of the cylinder 4 is illustrated), the heating devices $\mathbf{27}_1$, $\mathbf{27}_2$ and $\mathbf{27}_6$, $\mathbf{27}_7$ are connected to an electrical open loop and closed loop control device 31, which is furthermore connected to four temperature sensors $\mathbf{30}_1$, $\mathbf{30}_2$ and $\mathbf{30}_6$, $\mathbf{30}_7$. The temperature sensors 30 are arranged in a heat-permeable housing 32, which extends across the width c of the cylinder 4 and is fixed to the extension bends 19*a*, 19*b*. The temperature sensors $\mathbf{30}_1$, $\mathbf{30}_2$ are arranged radially spaced from and facing the edge region $\mathbf{4}e^{I}$ and the temperature sensors $\mathbf{30}_6$, $\mathbf{30}_7$ (not shown) are arranged radially spaced from and facing the edge region $\mathbf{4}e^{II}$. In this way the heat output of the heating devices $\mathbf{27}_1$, $\mathbf{27}_2$ and $\mathbf{27}_6$, $\mathbf{27}_7$ in the edge regions $\mathbf{4}e^{I}$ and $\mathbf{4}e^{II}$ can be adjusted to increase outwards.

Figure 6:
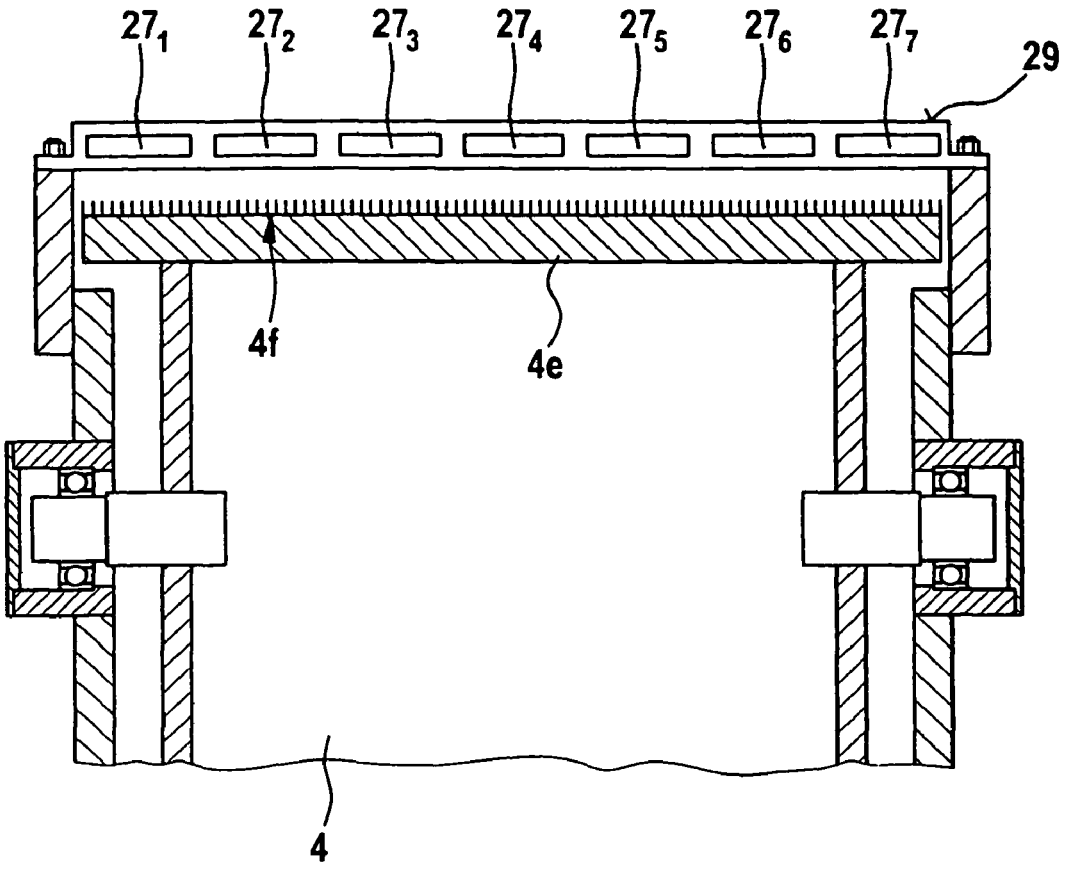
FIG. 6 shows a further embodiment in which the carding cylinder is generally as in FIG. 3, but in which heating devices are arranged across the entire working width, in particular for the uniform alteration of the carding gap across the working width.

In the embodiment of FIG. 6, seven inductive heating units $\mathbf{27}_1$ to $\mathbf{27}_7$, which are connected to the open loop and closed loop control device 31 (see FIG. 5), are arranged side by side across the entire width c of the cylinder 4. The heat output of the heating units $\mathbf{27}_1$ to $\mathbf{27}_7$, independently of or in addition to the embodiment illustrated in FIGS. 3 and 5, can be effected uniformly across the width c of the machine, so that the carding gap a (see FIG. 2) is uniformly altered across the width c. The carding nip a can be made smaller by energy input and enlarged by throttling the energy input. In this way it is possible, for example, to adjust a desired narrow carding nip a.

The cylinder surface is advantageously heated in zones. The temperature gradient across the working width is minimised by the roller heating unit and hence thermal expansion is evened out. The heating unit is divided into several zones across the working width so that different quantities of heat can be introduced (induced) in the roller surface. Heating of the cylinder is effected especially advantageously by means of an inductive heating unit. Only ferromagnetic materials are heated by this means and the fibre material is not affected. It is furthermore advantageous if the heating unit is integrated in an aluminium profile, without this itself being heated up.

The energy input is effected by an external device, namely by way of the induction coils $\mathbf{27}^{I}$ of the heating units 27, from outside the cylinder 4, and the induction heat is generated in the casing 4*e* of steel and the end discs 4*c*, 4*d* of the cylinder 4. Because energy, but not heat, is supplied for heat generation, the fibre material situated on the clothing 4*a* is not affected.

The aluminium profile 29 is not heated by the inductive heating unit 27.

The invention was explained using the example of energy input to the cylinder 4. Similarly, the invention can be applied to energy input to a covering and/or a work element lying radially opposite the cylinder 4, or to the energy input to both the cylinder 4 and to a covering and/or work element.

Although the foregoing invention has been described in detail by way of illustration and example for purposes of understanding, it will be obvious that changes and modifications may be practised within the scope of the appended claims.

What is claimed is:

1. An apparatus on a spinning preparation machine for adjusting a carding clearance, in which a clothed roller is opposed to one or more machine elements, defining between the clothing of the clothed roller and said one or more machine elements an adjustable carding clearance where, in operation, carding is effected and carding heat is generated, and the contour of at least one of the clothed roller and at least one said opposed element is alterable in response to heat, wherein the apparatus comprises a device to input energy variably across a working width of to at least one of said roller and at least one said opposed element, in which the carding clearance can be made smaller by the input of energy to said at least one of said roller and at least one said opposed element and/or can be enlarged by throttling of said input of energy.

2. An apparatus according to claim 1, in which the energy input and/or throttling of the energy input is arranged to increase towards the edge regions of the roller and/or said opposed machine element.

3. An apparatus according to claim 1, in which the energy input and/or throttling of the energy input is effected uniformly across the width of the machine.

4. An apparatus according to claim 1, wherein said device for providing said input of energy comprises a heating device.

5. An apparatus according to claim 1, in which the roller is the cylinder of a flat card or roller card and said at least one opposed element comprises a clothed carding element.

6. An apparatus according to claim 5, in which said at least one opposed component comprises one or more devices selected from separating blades, guide elements and clothed rollers.

7. An apparatus according to claim 1, in which the at least one opposed element comprises a clothed element and at least one of the clothed roller and clothed element opposed thereto is heated by energy input.

8. An apparatus according to claim 1, which is operable to adjust the carding clearance during operation of the spinning preparation machine.

9. An apparatus according to claim 2, which is arranged to effect substantially no energy input in the middle region of the at least one of the clothed roller or opposed element into which energy is input.

10. An apparatus according to claim 1, in which the at least one component comprises two or more zones in which the energy input is separately controllable.

11. An apparatus according to claim 1, in which a heating device is associated with a said opposed element.

12. An apparatus according to claim 11, in which said one or more opposed elements comprise a multiplicity of clothed elements opposed to the clothed roller, and there is a heating device associated with each of two or more said clothed elements.

13. An apparatus according to claim 1, in which a heating device is associated with the surface of the roller.

14. An apparatus according to claim 4, in which the heating device is an electrical heating device.

15. An apparatus according to claim 4, in which the heating device is an inductive heating device comprising a controllable electrical power circuit for adjusting the heat induced.

16. An apparatus according to claim 4, in which the heating device is arranged in a carrier arrangement comprising an aluminium profiled member.

17. An apparatus according to claim 16, in which a plurality of covering or work elements (modules) of corresponding dimensions are present at the roller, and the dimensions of the carrier arrangement over the length and width and are the same or substantially the same as those of a said covering element or work element (module) whereby the carrier arrangement including said heater is interchangeable with a said covering or work element.

18. An apparatus according to claim 1, further comprising one or more temperature sensors for detecting the temperature of at least one of said roller and opposed component and a control device for adjusting the energy input device in dependence upon temperature values detected by said one or more sensors.

19. An apparatus according to, claim 5 in which the roller carding cylinder consists of a ferromagnetic material.

* * * * *